US008453663B2

(12) United States Patent
Zordan et al.

(10) Patent No.: US 8,453,663 B2
(45) Date of Patent: Jun. 4, 2013

(54) CRUTCH EQUIPPED WITH RESTRAINING SAFETY MEANS

(76) Inventors: Valter Zordan, Valdagno (IT); Matteo Fioravanzo, Monticello Conte Otto (IT); Cesare Schiavi, Vicenza (IT)

( * ) Notice: Subject to any disclaimer, the term of this patent is extended or adjusted under 35 U.S.C. 154(b) by 54 days.

(21) Appl. No.: 12/998,461

(22) PCT Filed: Oct. 20, 2009

(86) PCT No.: PCT/IB2009/054621

§ 371 (c)(1),
(2), (4) Date: May 16, 2011

(87) PCT Pub. No.: WO2010/046849

PCT Pub. Date: Apr. 29, 2010

(65) Prior Publication Data

US 2011/0232709 A1 Sep. 29, 2011

(30) Foreign Application Priority Data

Oct. 23, 2008 (IT) ..... VR2008A0118

(51) Int. Cl.
*A61H 3/02* (2006.01)

(52) U.S. Cl.
USPC ..... 135/71; 135/65; 135/73; 623/28; 602/20

(58) Field of Classification Search
USPC ..... 135/65–66, 68, 69, 71–73; 602/20–21, 602/23–29; 24/307, 309, 310, 316, 16 R, 24/23 B, 41.1, 42, 68 R; 482/75–77, 79–80, 482/146–147; 623/28
See application file for complete search history.

(56) References Cited

U.S. PATENT DOCUMENTS

| | | | | |
|---|---|---|---|---|
| 4,924,924 | A * | 5/1990 | Stewart | 142/49 |
| 5,178,595 | A | 1/1993 | MacGregor | |
| 5,555,904 | A | 9/1996 | Stockwell | |
| 5,645,515 | A * | 7/1997 | Armstrong et al. | 482/75 |
| 5,671,765 | A | 9/1997 | Hagberg, Jr. | |
| 6,085,765 | A | 7/2000 | Sigsworth | |
| 6,279,591 | B1 * | 8/2001 | Obitts | 135/67 |
| 6,494,919 | B1 * | 12/2002 | Matthews | 623/32 |
| 6,517,586 | B2 * | 2/2003 | Lin | 623/28 |
| 7,422,025 | B1 * | 9/2008 | Waldstreicher et al. | 135/71 |

(Continued)

FOREIGN PATENT DOCUMENTS

| | | |
|---|---|---|
| WO | WO 89/00039 | 1/1989 |
| WO | WO 01/24758 | 4/2001 |
| WO | WO 2007/094769 | 8/2007 |

OTHER PUBLICATIONS

International Search Report.
Written Opinion of the International Searching Authority.

*Primary Examiner* — Winnie Yip
(74) *Attorney, Agent, or Firm* — Bucknam and Archer

(57) ABSTRACT

A crutch (10) for orthopaedic or similar purposes which can be used with the arms to support the body and/or the legs, the crutch (10) being equipped with a semicircular element (13) which in turn presents two wings (14, 15) facing the front part of the crutch according to the usual forms currently in use, the crutch being fitted, at the ends of the two wings (14, 15) of the semicircular element (13), with a strap (16) of appropriate length and shape to allow the forearm to be restrained in the semicircular support element (13).

8 Claims, 5 Drawing Sheets

U.S. PATENT DOCUMENTS

| | | | | |
|---|---|---|---|---|
| 8,156,932 | B2 * | 4/2012 | Lee | 128/99.1 |
| 8,172,730 | B2 * | 5/2012 | Emmert | 482/75 |
| 2009/0165834 | A1 * | 7/2009 | West | 135/65 |
| 2009/0235966 | A1 * | 9/2009 | Birnbaum | 135/66 |
| 2010/0234782 | A1 * | 9/2010 | Hu et al. | 602/13 |

* cited by examiner

CRUTCH EQUIPPED WITH RESTRAINING SAFETY MEANS

CROSS REFERENCE TO RELATED APPLICATIONS

This application is the National Stage of PCT/IB2009/054621filed on Oct. 20, 2009, which claims priority under 35 U.S.C. §119 of Italian Application No. VR2008A000118 filed on Oct. 23, 2008, the disclosure of which is incorporated by reference. The international application under PCT article 21(2) was published in English.

TECHNICAL FIELD

This invention refers to a crutch for orthopaedic purposes which can be used with an arm to support the body and/or the legs, and which is equipped with restraining safety means.

More specifically, this invention refers to a crutch with the feature of being made using restraining means that can be fitted preferably on the upper part of the forearm, that is to say just below the elbow or another more appropriate adjacent area.

The restraining means according to the invention superficially consist of straps, preferably the ratchet type, shaped and fitted in such a way as to progressively and adjustably close and clamp the loop which wraps around the upper and rear part of the forearm, although the fitting zones can be elsewhere.

This invention can be applied in the sector of components and accessories for orthopaedic devices, in particular crutches for supporting a person with the help of the arms.

PRIOR ART

It is known that the use of crutches allows a person to walk independently, using the strength of the arms pushing down to make up for any weakness in the legs, for example following trauma, lesions, orthopaedic procedures or similar.

Crutches normally consist of a rod which is adjustable in length, the upper part of which is equipped with a handle shaped in such a way that it can be gripped with one hand, while the upper end of the rod is equipped with an element that restrains the forearm, this element normally being semicircular in shape.

Traditional crutches are usually made from lightweight anodised aluminium, and are sometimes fitted with a shock absorber to attenuate the impact with the ground, with an antinoise ring and, for the most advanced models, with a non-slip anatomical injection-moulded grip for greater comfort and safety.

To use the crutches it is sufficient to grip the handle with one hand, ensuring that the semicircular element rests against the rear part of the forearm, and then to position the lower end of the crutch on the ground, thereby reducing the burden on the legs during walking.

One of the main problems encountered by technicians in this sector concerns the total absence of restraining means, which would instead be of use when the crutch is not being used, that is to say when it is necessary to use the arms and hands, for example to pick up objects while standing still.

It is in fact known that at such times, when it is necessary to pick up an object or to use one's hands while standing, crutches constitute a problem for the user who is obliged to abandon the orthopaedic support for the time needed to place it somewhere, with all the consequent risks that this involves.

DESCRIPTION OF THE INVENTION

This invention proposes to provide a crutch or orthopaedic device to reduce the weight burden on the legs and which can be used with the forearm, that can eliminate or at least reduce the problems described above, through the use of appropriate restraining means that can be fixed around the forearm.

The invention makes it possible to resolve the problem of positioning the crutch when it is necessary to use the arms and hands, by means of a coupling system that allows the crutch to adhere to and restrain the forearm, permitting the hands to be freely used at the same time.

This is achieved by means of an orthopaedic crutch equipped with restraining means to allow free use of the hands, the features of which are described in the main claim.

The dependent claims describe advantageous embodiments of the invention.

The main advantages of this solution, in addition to those deriving from its construction simplicity, concern first of all the fact that the means according to the invention allow the user to use his/her hands without the need to rest the crutch elsewhere, sometimes even at a certain distance from the user, with all the consequent advantages.

According to the invention, the crutch is therefore equipped with forearm restraining means that can be preferably positioned at the upper part of the crutch where the semicircular forearm support is present.

The restraining means according to the invention substantially consist of straps which close the loop at the semicircular forearm support, using ratchet-type blocking elements for this purpose.

DESCRIPTION OF THE DRAWINGS

Other features and advantages of the invention will become clear on reading the description given below of one embodiment of the invention, provided as a non-binding example, with the help of the accompanying drawings in which.

DESCRIPTION OF ONE EMBODIMENT OF THE INVENTION

Figure 1:
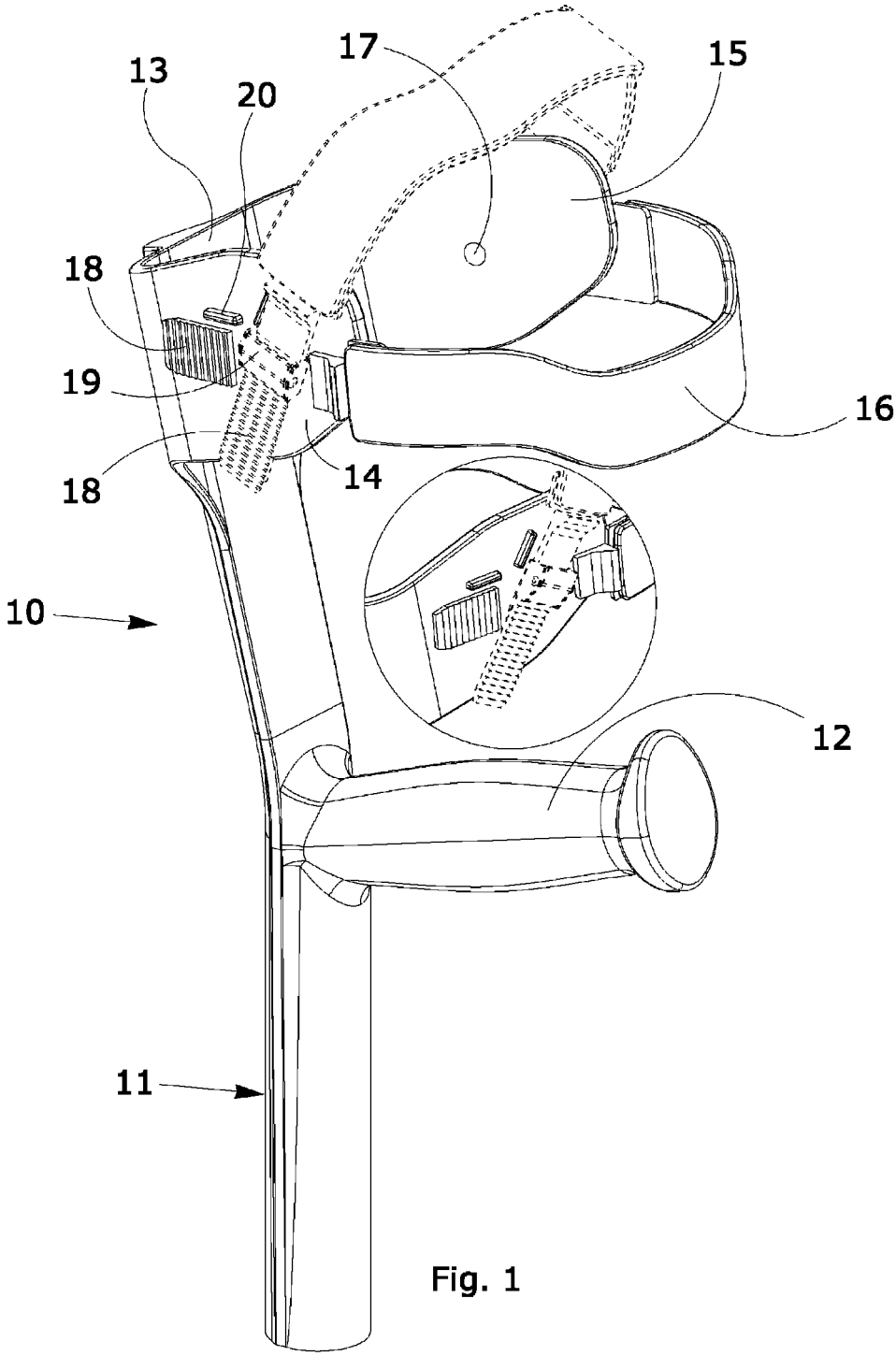
FIG. 1 shows a schematic and prospective view of the crutch equipped with means according to the invention for restraining the forearm and when it is necessary to use one's hands.

With reference to the accompanying drawings, the number 10 indicates the body of the crutch, substantially consisting of a rod 11 of appropriate length and which may be adjustable, generally equipped with a grip 12 made according to the most common shapes and positioned substantially at right angles to the rod 11.

The upper end of the crutch 10 is fitted with a semicircular element 13 designed to accommodate the rear part of the forearm, in such a way that the crutch can be gripped in the most appropriate way to guarantee the stability of the structure in relation to the ground.

The semicircular element 13 has two wings 14 and 15 facing the front part of the crutch and shaped in the usual way.

According to this invention, the ends of the wings 14 and 15 of the semicircular element 13 are fitted with a strap 16 of appropriate shape and length to allow restraint of the forearm within the semicircular support 13.

For this purpose, the strap 16 is fixed at one side by a pin 17 to the end 15, and on the other side it can be attached to the end 14 by ratchet-type restraining means.

Figures 2, 3, 4:
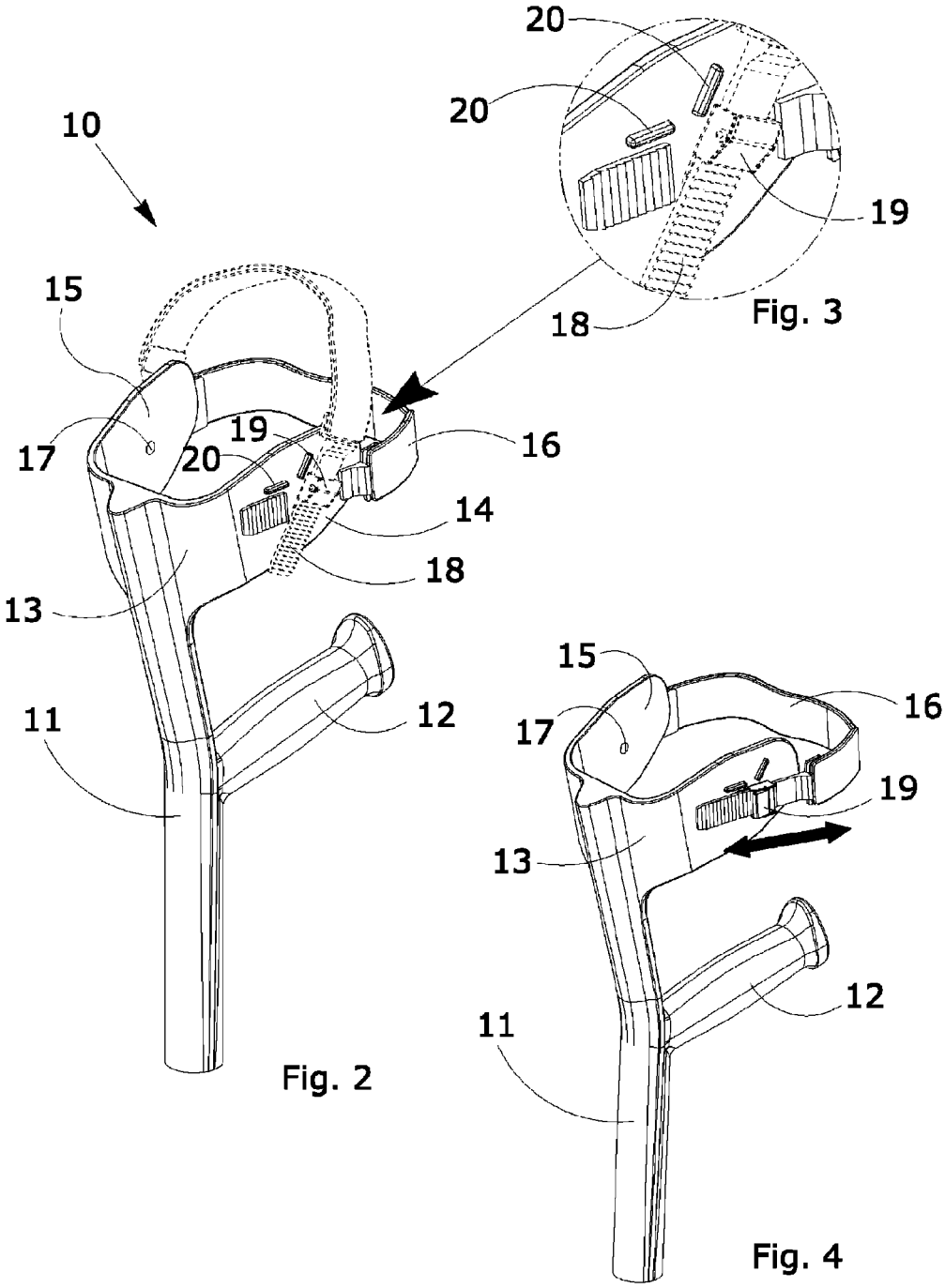
FIG. 2 represents a schematic view of the crutch equipped with means according to the invention shown from the rear part of the crutch.
FIG. 3 shows a schematic detailed view of the ratchet-type blocking elements.
FIG. 4 represents a schematic view of the crutch shown from the rear and during the blocking of the ratchet on the forearm.
Figure 5:
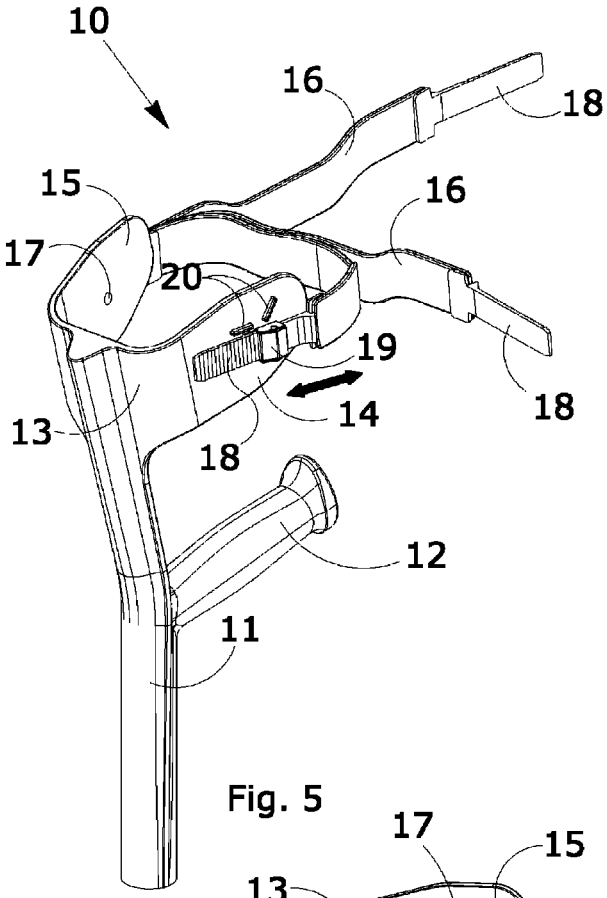
FIG. 5 shows a schematic view of the crutch according to the invention with the straps in three different open and closed positions.
Figure 6:
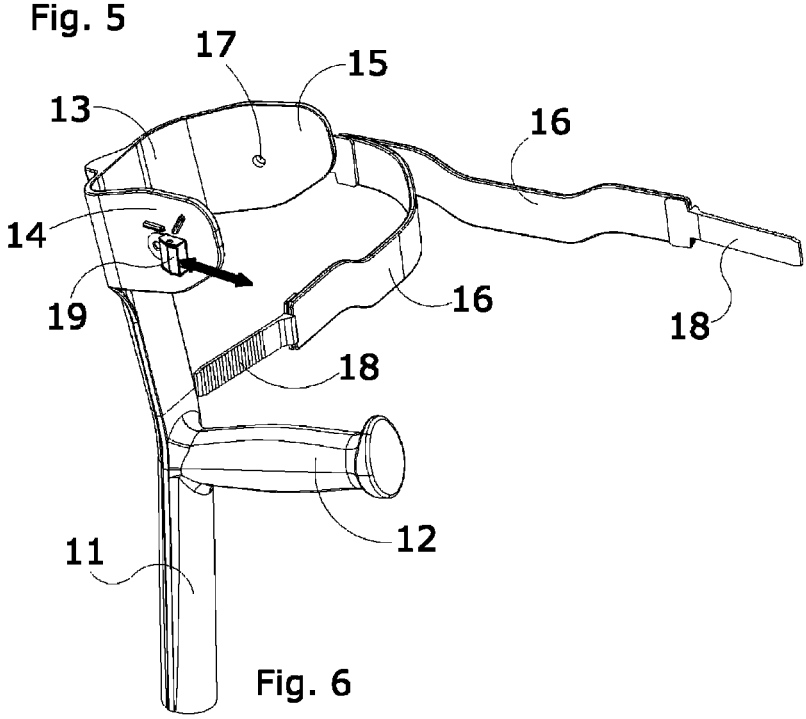
FIG. 6 shows a schematic view of the crutch seen from the front.

More specifically, as clearly shown in FIG. 2 and in detail in FIG. 3, the free end of the strap 16 ends with a toothed tailpiece 18 which engages with a buckle 19 fitted rotatingly on the wing 14 of the semicircular element 13 of the crutch. The buckle 19 comprises an elastic tab with an opposing spring to restrain the toothed tailpiece 18 in its most appropriate position.

As can be seen in the figures, the buckle 19 rotates, being fitted on a pin; the stop points for the rotation of the toothed tailpiece 18 consist of protruding notches 20 on the outer face of the wing 14.

The strap 16 can therefore be rotated angularly within a certain range, the limits of which are defined by the position of the protruding notches 20.

The strap closing element 16 is thus free to move at an angle around the two wings 14 and 15 of the crutch, making it possible to follow the movement of the forearm when the hands are used to pick up objects or for any other reason.

To use the crutch according to this invention, it is therefore sufficient to insert the forearm in the semicircular element 13, and grip the handle 12 with one hand.

At this point the forearm is restrained in position by fastening the strap 16, inserting the toothed tailpiece 18 in the tab-hinged buckle 19.

If it is necessary to use the hands to pick something up or for any other reason, it is sufficient to let go of the handle 12, without having to place the crutch somewhere, as was the case with known solutions.

The strap 16 keeps the forearm restrained to the crutch, allowing free movement of the hands while remaining upright.

The movement of the arms is helped by the angular movement of the strap 16 which follows the movement of the arms.

Figure 8:
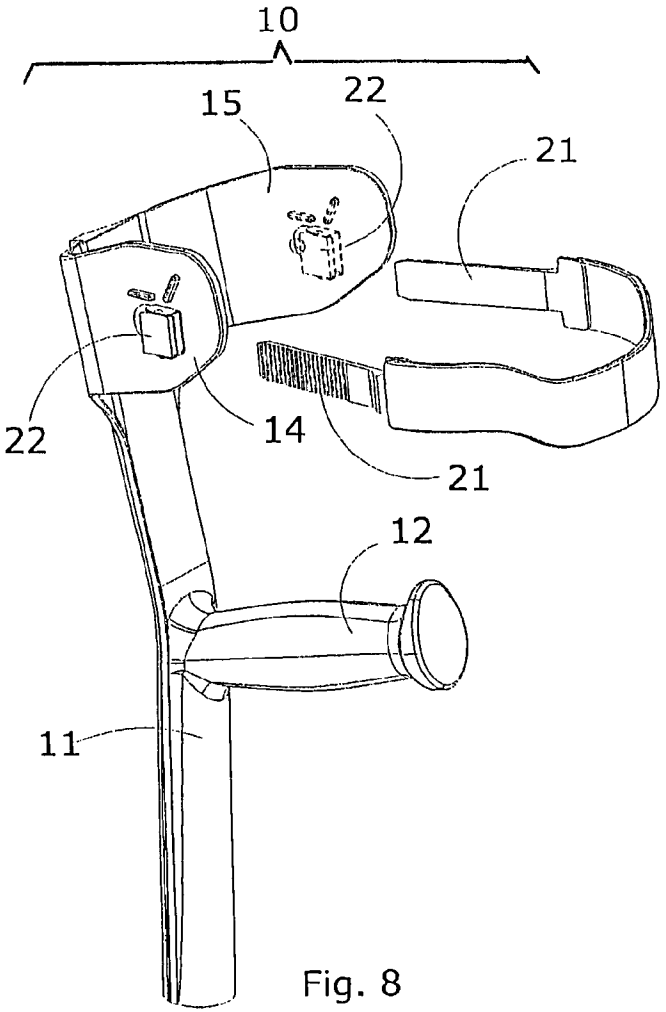
FIG. 8 shows a schematic view of the crutch according to the invention, in which the strap is fixed on both sides with two ratchets.
Figure 7:
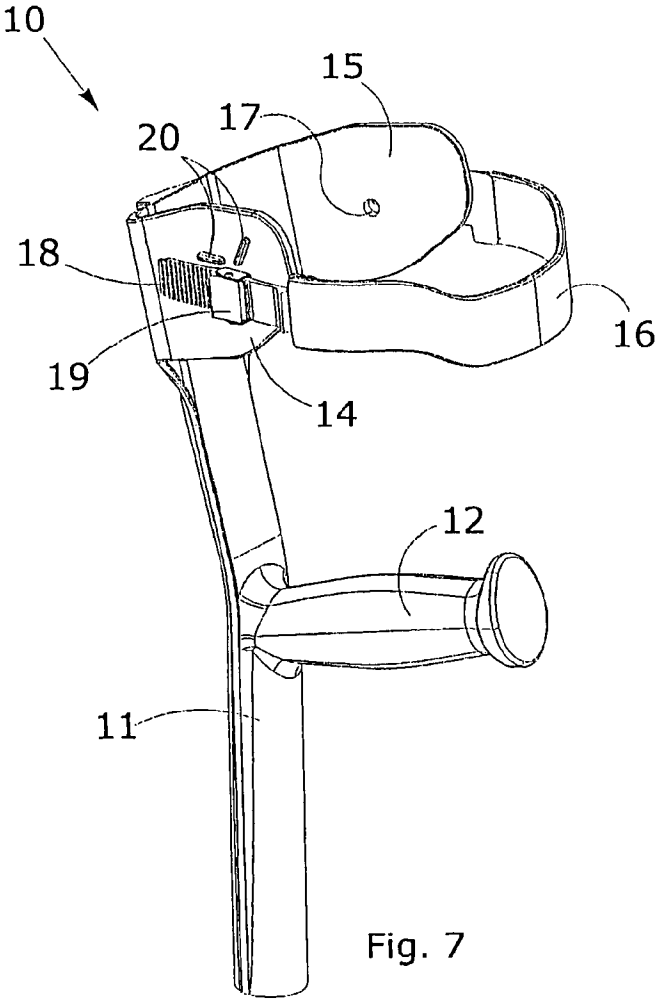
FIG. 7 shows a schematic and prospective view of the crutch according to the invention with the straps in the closed position.

According to another embodiment, the strap 16 can be fitted with two toothed tailpieces 21, as can be seen in FIG. 8, thus being fixed with the ratchet mechanism on both sides with two ratchets 22, thereby increasing the adjustment angle.

Figure 9:
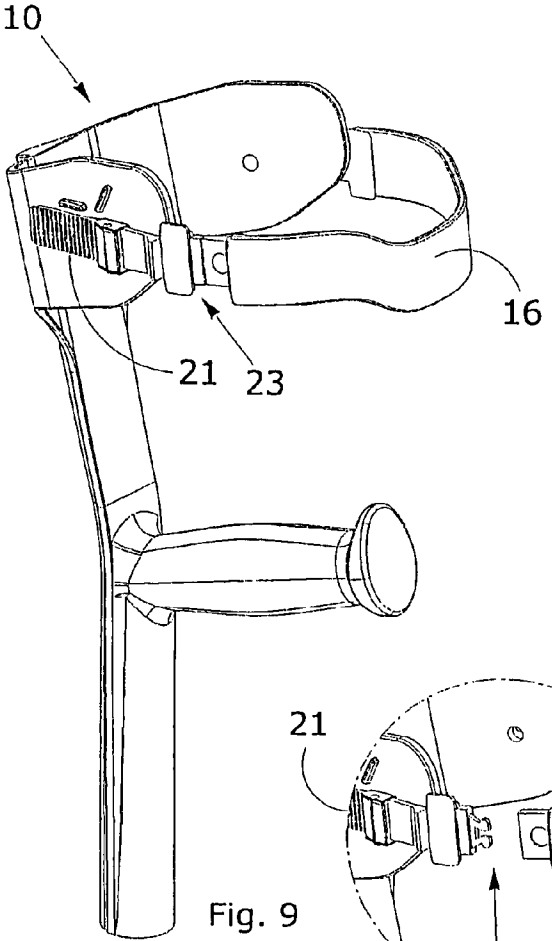
FIG. 9 and in particular FIG. 10 represent schematic views of the crutch according to one embodiment with rapid release in the event of a fall.
Figure 10:
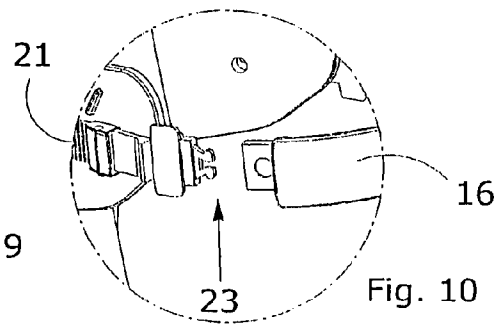

FIG. 9 and particularly FIG. 10 show schematic views of the crutch according to further embodiments, and specifically in the case in which the strap 16 is equipped with a rapid-release safety system 23, in which the strap is automatically released in the event of a fall.

Figure 11:
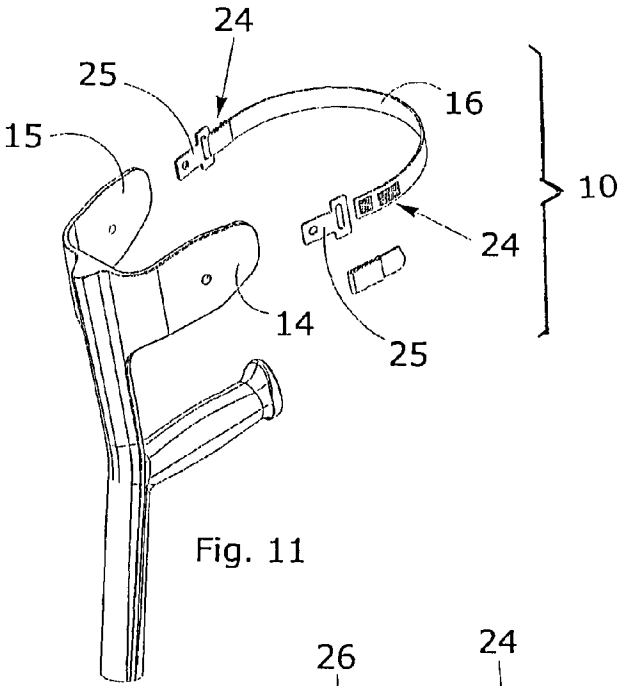
FIG. 11 and in particular FIG. 12 represent schematic views of the crutch according to another embodiment in which the "coupling" system consists of a Velcro strip.
Figure 12:
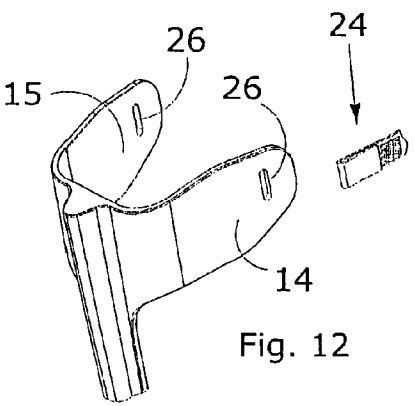

FIG. 11 and particularly FIG. 12 show another embodiment in which the coupling system consists of a strip with Velcro-type ends 24.

In this case, the strap 16 is fixed by means of Velcro-type ends 24, inserted in adjustable slotted hooks 25 attached to the two wings 14 and 15 of the crutch.

In this case, the strap is fastened by inserting it the slotted hooks 25 and folding the Velcro ends 24 back over themselves. The strap with Velcro ends can also be inserted in slots 26 cut in the two wings 14 and 15 of the crutch.

The strap 16 cam also be fixed in other ways which are not described here.

As can be seen, the described accessory improves the use of traditional crutches, making it possible to use the hands when required without having to rest the crutch somewhere or to move away from it.

The invention is described above with reference to a preferred embodiment. It is nevertheless clear that the invention is susceptible to numerous variations which lie within the scope of its disclosure, within the framework of technical equivalents.

The invention claimed is:

1. A crutch (10) for orthopaedic or similar purposes adapted to be used with an arm of the user to support the user's body and/or legs, said crutch (10) comprising:

an elongated rod (11) adapted to extend to the ground;

a grip (12) extending substantially at a right angle from said rod (11) adapted to be gripped by a hand of the user;

a semicircular element (13) arranged at an upper end of said crutch adapted to accommodate a forearm of the user, said semicircular element including two wings (14, 15) extending fowardly from said semicircular element (13); and a strap (16) having first and second ends extending between said two wings (14, 15) and adapted to restrain the user's forearm in said semicircular element (13), each of said first and second ends of said strap (16) being pivotally attached to said two wings (14, 15), respectively, whereby to permit angular movement of said strap (16) about said two wings so that upon release of said grip (12) the user retains possession of the crutch (10) while also allowing movement of the user's forearm.

2. The crutch (10) for orthopaedic or similar purposes as defined in claim 1, wherein one of said first and second ends of said strap (16) terminates in a toothed tailpiece (18) engaging with a buckle (19) pivotally attached to the respective one of said two wings (14, 15) to which the other one of said first and second ends of said strap (16) is not attached.

3. The crutch (10) for orthopaedic or similar purposes as defined in claim 2, wherein said buckle (19) includes a spring biased elastic tab for restraining the toothed tailpiece (18) of said strap (16) in a most appropriate position.

4. The crutch (10) for orthopaedic or similar purposes as defined in claim 2, which further includes protruding notches (20) arranged on the one of said two wings (14, 15) of said semicircular element (13) to which said buckle (19) is attached which limit the rotation of said strap (16) when said toothed tailpiece (18) is engaged with said buckle (19).

5. The crutch (10) for orthopaedic or similar purposes as defined in claim 4, wherein the rotational limit of strap (16) is established by the positioning of said protruding notches (20) acting as limit stops.

6. The crutch (10) for orthopaedic or similar purposes as defined in claim 1, wherein each of said first and second ends of said strap (16) terminates in a toothed tailpiece (21) each engaging with a buckle (22) each pivotally attached to one of said two wings (14, 15) of said semicircular element (13).

7. The crutch (10) for orthopaedic or similar purposes as defined in claim 1, which further includes a rapid-release safety system (23) for said strap (16) whereby said strap (16) is released in the event of a fall.

8. The crutch (10) for orthopaedic or similar purposes as defined in claim 1, wherein the first and second ends of said strap (16) are fitted with hook and loop closures and are adapted to be inserted in slotted hooks (25, 26) pivotally attached to said two wings (14, 15) of said semicircular element (13).

* * * * *

UNITED STATES PATENT AND TRADEMARK OFFICE

CERTIFICATE OF CORRECTION

PATENT NO. : 8,453,663 B2
APPLICATION NO. : 12/998461
DATED : June 4, 2013
INVENTOR(S) : Zordan et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 75 days.

Signed and Sealed this
Eighth Day of September, 2015

Michelle K. Lee

Michelle K. Lee
*Director of the United States Patent and Trademark Office*